US009062677B2

(12) United States Patent
Lee et al.

(10) Patent No.: US 9,062,677 B2
(45) Date of Patent: Jun. 23, 2015

(54) COMPRESSOR

(75) Inventors: Kangwook Lee, Changwon-si (KR); Jin-Ung Shin, Changwon-si (KR); Yongchol Kwon, Changwon-si (KR); Geun-Hyoung Lee, Busan (KR)

(73) Assignee: LG ELECTRONICS INC., Seoul (KR)

( * ) Notice: Subject to any disclaimer, the term of this patent is extended or adjusted under 35 U.S.C. 154(b) by 710 days.

(21) Appl. No.: 13/054,970

(22) PCT Filed: Nov. 27, 2008

(86) PCT No.: PCT/KR2008/007008

§ 371 (c)(1),
(2), (4) Date: Jan. 20, 2011

(87) PCT Pub. No.: WO2010/010996

PCT Pub. Date: Jan. 28, 2010

(65) Prior Publication Data

US 2011/0123381 A1 May 26, 2011

(30) Foreign Application Priority Data

| | | |
|---|---|---|
| Jul. 22, 2008 | (KR) | 10-2008-0071381 |
| Nov. 13, 2008 | (KR) | 10-2008-0112744 |
| Nov. 13, 2008 | (KR) | 10-2008-0112753 |
| Nov. 13, 2008 | (KR) | 10-2008-0112758 |

(51) Int. Cl.
*F04C 15/00* (2006.01)
*F04C 23/00* (2006.01)
(Continued)

(52) U.S. Cl.
CPC ..... *F04C 23/008* (2013.01); *F04C 15/0007* (2013.01); *F04C 18/32* (2013.01); *F04C 29/0085* (2013.01); *F04C 2240/603* (2013.01)

(58) Field of Classification Search
CPC ..... F04C 15/0007; F04C 2/00
USPC ..... 417/313, 312, 356, 410.4, 902, 423.14; 184/6.23, 104; 418/11, 60, 63–66, 228
See application file for complete search history.

(56) References Cited

U.S. PATENT DOCUMENTS

| | | | |
|---|---|---|---|
| 1,526,449 | A | 2/1925 | Wishart |
| 1,947,016 | A | 2/1934 | Mallory |

(Continued)

FOREIGN PATENT DOCUMENTS

| | | |
|---|---|---|
| CN | 1963224 | 5/2007 |
| EP | 1 798 372 A1 | 6/2007 |

(Continued)

OTHER PUBLICATIONS

European Search Report dated Feb. 1, 2012 issued in Application No. 08 87 6616.

(Continued)

*Primary Examiner* — Christopher Bobish
(74) *Attorney, Agent, or Firm* — Ked & Associates, LLP

(57) ABSTRACT

A compressor is provided that includes a stator, a cylinder type rotor rotated within the stator by a rotating electromagnetic field of the stator and that defines a compression chamber inside, a roller that rotates within the compression chamber of the cylinder type rotor by a rotational force transferred from the rotor and compresses a refrigerant during rotation, a rotational shaft integrally formed with the roller and that protrudes from one side of the roller in an axial direction, a vane that divides the compression chamber into a suction region and a compression region, and transfers the rotational force from the cylinder type rotor to the roller, and a shaft cover and a cover joined to the cylinder type rotor in an axial direction that form the compression chamber in which the refrigerant is compressed. The shaft cover includes a suction port through which the refrigerant is sucked, and the cover receives the rotational shaft therethrough.

19 Claims, 10 Drawing Sheets

(51) Int. Cl.
*F04C 18/32* (2006.01)
*F04C 29/00* (2006.01)

(56) References Cited

U.S. PATENT DOCUMENTS

| | | | | |
|---|---|---|---|---|
| 1,998,604 | A | 4/1935 | Belden | |
| 2,246,273 | A * | 6/1941 | Davidson | 418/77 |
| 2,246,275 | A | 6/1941 | Ward | |
| 2,246,276 | A | 6/1941 | Ward | |
| 2,309,577 | A | 1/1943 | Ward | |
| 2,324,434 | A | 7/1943 | Shore | |
| 2,331,878 | A | 10/1943 | Wentworth | |
| 2,420,124 | A * | 5/1947 | Coulson | 417/356 |
| 2,440,593 | A | 4/1948 | Miller | |
| 2,898,032 | A | 8/1959 | Bernhard | |
| 3,070,078 | A | 12/1962 | Horst | |
| 3,499,600 | A | 3/1970 | McGregor | |
| 3,723,024 | A * | 3/1973 | Sawai et al. | 418/159 |
| 4,478,559 | A | 10/1984 | Andrione et al. | |
| 4,629,403 | A | 12/1986 | Wood | |
| 4,710,111 | A | 12/1987 | Kubo | |
| 4,714,416 | A * | 12/1987 | Sano | 418/63 |
| 4,844,703 | A * | 7/1989 | Watanabe et al. | 417/295 |
| 5,522,235 | A * | 6/1996 | Matsuoka et al. | 62/324.6 |
| 5,547,344 | A * | 8/1996 | Sugiyama et al. | 417/32 |
| 5,564,916 | A | 10/1996 | Yamamoto et al. | |
| 5,577,903 | A | 11/1996 | Yamamoto | |
| 5,580,231 | A | 12/1996 | Yasui | |
| 5,616,019 | A | 4/1997 | Hattori et al. | |
| 6,077,058 | A | 6/2000 | Saitou et al. | |
| 6,213,732 | B1 * | 4/2001 | Fujio | 417/312 |
| 6,478,558 | B2 | 11/2002 | Yamanaka et al. | |
| 6,484,846 | B1 | 11/2002 | Parker | |
| 6,491,063 | B1 * | 12/2002 | Benatav | 137/625.43 |
| 6,749,405 | B2 * | 6/2004 | Bassine | 417/313 |
| 6,881,041 | B2 | 4/2005 | Lee | |
| 6,929,455 | B2 | 8/2005 | Dreiman et al. | |
| 7,029,252 | B2 | 4/2006 | Masuda et al. | |
| 7,104,764 | B2 * | 9/2006 | Lee et al. | 417/218 |
| 7,217,110 | B2 | 5/2007 | Dreiman | |
| 7,293,966 | B2 * | 11/2007 | Cho et al. | 417/410.3 |
| 7,344,367 | B2 | 3/2008 | Manole | |
| 7,361,004 | B2 | 4/2008 | Hwang et al. | |
| 7,556,485 | B2 | 7/2009 | Kanayama et al. | |
| 7,704,060 | B2 | 4/2010 | Morimoto et al. | |
| 2004/0071570 | A1 | 4/2004 | Dreiman et al. | |
| 2005/0008519 | A1 | 1/2005 | Masuda et al. | |
| 2005/0031465 | A1 | 2/2005 | Dreiman et al. | |
| 2005/0201884 | A1 | 9/2005 | Dreiman | 418/173 |
| 2006/0159570 | A1 | 7/2006 | Manole | |
| 2007/0059189 | A1 * | 3/2007 | Nakano et al. | 417/415 |
| 2007/0122284 | A1 * | 5/2007 | Bae et al. | 416/179 |
| 2012/0171065 | A1 | 7/2012 | Lee | |

FOREIGN PATENT DOCUMENTS

| | | | |
|---|---|---|---|
| FR | 345995 | A | 12/1904 |
| FR | 1367234 | A | 7/1964 |
| GB | 478146 | | 1/1938 |
| JP | 57-186086 | A | 11/1982 |
| JP | 60-187783 | A | 9/1985 |
| JP | 60-206995 | A | 10/1985 |
| JP | 61-187591 | A | 8/1986 |
| JP | 01-232191 | A | 9/1989 |
| JP | 2008-069643 | | 3/2008 |
| KR | 20-0252922 | | 11/2001 |
| KR | 10-2004-0003346 | | 1/2004 |
| KR | 10-2005-0012009 | | 1/2005 |
| KR | 10-2007-0073314 | | 7/2007 |
| WO | WO 2007/074637 | | 7/2007 |
| WO | WO 2008/004983 | | 1/2008 |

OTHER PUBLICATIONS

European Search Report dated Feb. 1, 2012 issued in Application No. 08 87 6617.
European Search Report dated Feb. 1, 2012 issued in Application No. 08 87 6619.
U.S. Notice of Allowance issued in U.S. Appl. No. 13/055,026 dated Sep. 12, 2013.
U.S. Office Action issued in U.S. Appl. No. 13/055,020 dated Sep. 23, 2013.
U.S. Office Action issued in U.S. Appl. No. 13/055,040 dated Oct. 10, 2013.
U.S. Office Action issued in U.S. Appl. No. 13/054,963 dated Oct. 10, 2013.
Chinese Office Action dated Dec. 4, 2012.
U.S. Office Action issued in U.S. Appl. No. 13/054,981 dated Mar. 26, 2013.
U.S. Office Action issued in U.S. Appl. No. 13/055,026 dated Mar. 25, 2013.
International Search Report issued in PCT Application No. PCT/KR2008/007014 dated Feb. 10, 2010.
International Search Report issued in PCT Application No. PCT/KR2008/007006 dated Feb. 10, 2010.
International Search Report issued in PCT Application No. PCT/KR2008/007007 dated Feb. 16, 2010.
International Search Report issued in PCT Application No. PCT/KR2008/007015 dated Feb. 10, 2010.
International Search Report issued in PCT Application No. PCT/KR2008/007016 dated Feb. 16, 2010.
International Search Report issued in PCT Application No. PCT/KR2008/007008 dated Feb. 16, 2010.
U.S. Office Action issued in U.S. Appl. No. 13/054,981 dated Nov. 21, 2013.
Korean Office Action dated Jun. 2, 2014. (0112746).
Korean Office Action dated Jun. 2, 2014. (0112749).
U.S. Office Action issued in U.S. Appl. No. 13/054,981 dated Jun. 20, 2014.
Korean Office Action dated Jun. 24, 2014. (0112740).
U.S. Office Action issued in U.S. Appl. No. 13/055,020 dated Jun. 25, 2014.
U.S. Notice of Allowance issued in U.S. Appl. No. 13/054,963 dated Jun. 30, 2014.
U.S. Office Action issued in U.S. Appl. No. 13/055,020 dated Mar. 10, 2014.
Korean Office Action dated Jul. 29, 2014. (051523816).
Korean Office Action dated Jul. 29, 2014. (051556722).
U.S. Office Action issued in U.S. Appl. No. 13/054,981 dated Nov. 6, 2014.
U.S. Office Action issued in U.S. Appl. No. 13/055,020 dated Nov. 24, 2014.

* cited by examiner

COMPRESSOR

TECHNICAL FIELD

The present invention relates in general to a compressor, and more particularly, to a compressor having a structure which is suitable for compact design by forming a compression chamber inside a compressor by means of a rotor of electromotive mechanism for driving the compressor, which can maximize the compression efficiency by minimizing frictional loss between rotary elements inside the compressor, and which can minimize a refrigerant leak within the compression chamber.

BACKGROUND ART

In general, a compressor is a mechanical apparatus that receives power from a power generation apparatus such as an electric motor, a turbine or the like and compresses air, refrigerant or various operation gases to raise a pressure. The compressor has been widely used in electric home appliances such as a refrigerator and an air conditioner, or in the whole industry.

The compressors are roughly classified into a reciprocating compressor wherein a compression chamber to/from which an operation gas is sucked and discharged is defined between a piston and a cylinder and refrigerant is compressed as the piston linearly reciprocates inside the cylinder, a rotary compressor which compresses an operation gas in a compression chamber defined between an eccentrically-rotated roller and a cylinder, and a scroll compressor wherein a compression chamber to/from which an operation gas is sucked and discharged is defined between an orbiting scroll and a fixed scroll and refrigerant is compressed as the orbiting scroll rotates along the fixed scroll.

Although the reciprocating compressor is excellent in mechanical efficiency, its reciprocating motion causes serious vibrations and noise problems. Because of this problem, the rotary compressor has been developed as it has a compact size and demonstrates excellent vibration properties.

The rotary compressor is configured in a manner that a motor and a compression mechanism part are mounted on a drive shaft in a hermetic container, a roller fitted around an eccentric portion of the drive shaft is positioned inside a cylinder that has a cylinder shape compression chamber therein, and at least one vane is extended between the roller and the compression chamber to divide the compression chamber into a suction region and a compression region, with the roller being eccentrically positioned in the compression chamber. In general, vanes are supported by springs in a recess of the cylinder to pressurize surface of the roller, and the vane(s) as noted above divide(s) the compression chamber into a suction region and a compression region. In general, vanes are supported by springs in a recess of the cylinder to pressurize surface of the roller, and the vane(s), as noted above, divide(s) the compression chamber into a suction region and a compression region. The suction region expands gradually with the rotation of the drive shaft to suck refrigerant or a working fluid into it, while the compression region shrinks gradually at the same time to compress refrigerant or a working fluid in it.

In such a conventional rotary compressor, the eccentric portion of the drive shaft continuously makes a sliding contact, during its rotation, with an interior surface of a stationary cylinder where the roller is secured and with the tip of the vane where the roller is also secured. A high relative velocity is created between constituent elements making a sliding contact with each other, and this generates frictional loss, eventually leading to degradation of compressor efficiency. Also, there is still a possibility of a refrigerant leak at the contact surface between the vane and the roller, thereby causing degradation of mechanical reliability.

Unlike the conventional rotary compressors subject to stationary cylinders, U.S. Pat. No. 7,344,367 discloses a rotary compressor having a compression chamber positioned between a rotor and a roller rotatably mounted on a stationary shaft. In this patent, the stationary shaft extends longitudinally inwardly within a housing and a motor includes a stator and a rotor, with the rotor being rotatably mounted on the stationary shaft within the housing the roller being rotatably mounted on an eccentric portion that is integrally formed with the stationary shaft. Further, a vane is interposed between the rotor and the roller to let the roller rotate along with the rotation of the roller, such that a working fluid can be compressed within the compression chamber. However, even in this patent, the stationary shaft still makes a sliding contact with an interior surface of the roller so a high relative velocity is created between them and the patent still shares the problems found in the conventional rotary compressor.

Meanwhile, WO2008/004983 discloses another type of rotary compressors, comprising: a cylinder, a rotor mounted in the cylinder to rotate eccentrically with respect to the cylinder, and a vane positioned within a slot which is arranged at the rotor, the vane sliding against the rotor, wherein the vane is connected to the cylinder to transfer a force to the cylinder rotating along with the rotation of the rotor, and wherein a working fluid is compressed within a compression chamber defined between the cylinder and the rotor. However, these rotary compressors require a separate electric motor for driving the rotor because the rotor rotates by a drive force transferred through the drive shaft. That is, when it comes to the rotary compressor in accordance with the disclosure, a separate electric motor is stacked up in the height direction about the compression mechanism part consisting of the rotor, the cylinder and the vane, so the total height of the compressor inevitably increases, thereby making difficult to achieve compact design.

DISCLOSURE OF INVENTION

Technical Problem

The present invention is conceived to solve the aforementioned problems in the prior art. An object of the present invention is to provide a compressor which is suitable for compact design by forming a compression chamber inside a compressor by means of a rotor of electromotive mechanism for driving the compressor, and which can minimize frictional loss by reducing relative velocity between rotary elements inside the compressor.

Another object of the present invention is to provide a compressor having a structure to minimize a refrigerant leak within the compression chamber.

Technical Solution

An aspect of the present invention provides a compressor, comprising: a stator; a cylinder type rotor rotating within the stator by a rotating electromagnetic field from the stator, with the rotor defining a compression chamber inside; a roller rotating within the compression chamber of the cylinder type rotor by a rotational force transferred from the rotor, with the roller compressing refrigerant during rotation; an axis of rotation integrally formed with the roller and protruding from one side of the roller in an axial direction; a vane dividing the compression chamber into a suction region where refrigerant is sucked in and a compression region where the refrigerant is compressed/discharged from, with the vane transferring the rotational force from the cylinder type rotor to the roller; and a shaft cover and a cover joined to the cylinder type rotor in an axial direction and forming the compression chamber for compression of refrigeration therebetween, the shaft cover including a suction port used for refrigerant suction, the cover receiving the axis of rotation therethrough.

In an exemplary embodiment of the invention, the shaft cover includes a groove on the opposite side of the roller.

In an exemplary embodiment of the invention, the compressor is provided to an interior of a hermetic container, with the compressor further comprising a mechanical seal installed between the hermetic container and the shaft cover for rotatably supporting the shaft cover.

In an exemplary embodiment of the invention, the compressor further comprises a muffler joined to the shaft cover in the axial direction and including a suction chamber communicated with the suction port in the shaft cover.

In an exemplary embodiment of the invention, the compressor further comprises a hermetic container for housing a stator, a cylinder type rotor, a roller, an axis of rotator, a vane, a shaft cover/cover, and a muffler, with the hermetic container being connected to a suction tube and a discharge tube used for refrigerant suction/discharge, and the suction chamber of the muffler further comprises a suction port, with the suction chamber of the muffler being communicated with an interior space of the hermetic container.

In an exemplary embodiment of the invention, the shaft cover includes a discharge port through which refrigerant is discharged from the compression chamber, and the muffler is provided to compart a discharge chamber communicated with the discharge port in the shaft cover separately from the suction chamber.

In an exemplary embodiment of the invention, the shaft cover includes a hollow shaft having a contact surface with the roller being covered, and wherein the shaft includes a discharge guide passage inside to enable communication between the discharge chamber of the muffler and the shaft of the shaft cover.

In an exemplary embodiment of the invention, suction guide passage formed in the shaft comprises a first suction guide passage formed in an axial direction of the shaft, and a second suction guide passage formed in a radial direction of the shaft.

In an exemplary embodiment of the invention, the shaft is connected to a discharge tube by a mechanical seal.

In an exemplary embodiment of the invention, the compressor is provided to an interior of a hermetic container, with the compressor further comprising a bearing member secured onto the inside of the hermetic container for rotatably supporting the cylinder type rotor, the roller, and axes of rotation thereof.

In an exemplary embodiment of the invention, the beating member comprises a first bearing in contact with an outer circumferential surface of the axis of rotation, a second bearing in contact with one side of the roller in the axial direction, and third and fourth bearings in contact with an inner circumferential surface of the cover and one side of the cover in the axial direction, respectively.

In an exemplary embodiment of the invention, the suction port in the shaft cover is positioned on more rear side than the vain with respect to a rotation direction of the cylinder type rotor and the roller.

In an exemplary embodiment of the invention, the discharge port in the shaft cover is positioned on more front side than the vain with respect to a rotation direction of the cylinder type rotor and the roller.

Another aspect of the present invention provides a compressor, comprising: a hermetic container including a suction tube and a discharge tube; a stator secured within the hermetic container; a first rotating member rotating by a rotating electromagnetic field from the stator, about a first axis of rotation which is collinear with a center of the stator and extended in a longitudinal direction, with the first rotating member comprising a shaft cover which includes a suction port and a discharge port secured onto one side in an axial direction and opened in communication with a compression chamber, and a cover secured onto the other side in the axial direction; a second rotating member rotating within the first rotating member by a rotational force transferred from the first rotating member, with the second rotating member rotating about a second axis of rotation which is extended through the cover and compressing refrigerant in a compression chamber which is defined between the first and second rotating members; a vane dividing the compression chamber into a suction region where refrigerant is sucked in and a compression region where the refrigerant is compressed/discharged from, with the vane transferring the rotational force from the first rotating member to the second rotating member; a bearing secured within the hermetic container for rotatably supporting the first rotating member and the second rotating member, and axes of rotation thereof; and a muffler joined to a shaft cover, with the muffler being communicated with a discharge port in the shaft cover.

In another exemplary embodiment of the invention, centerline of a second axis of rotation is spaced apart from a centerline of a first axis of rotation.

In another exemplary embodiment of the invention, a longitudinal centerline of the second rotating member is collinear with the centerline of the second axis of rotation.

In another exemplary embodiment of the invention, the longitudinal centerline of the second rotating member is spaced apart from the centerline of the second axis of rotation.

In another exemplary embodiment of the invention, the centerline of the second axis of rotation is collinear with the centerline of the first axis of rotation, and the longitudinal centerline of the second rotating member is spaced apart from the centerlines of the first axis of rotation and the second axis of rotation.

In another exemplary embodiment of the invention, the muffler comprises a suction chamber communicated with a suction port in the shaft cover, and a discharge chamber communicated with the discharge part in the shaft cover, with the discharge chamber separately defined from the suction chamber, and the shaft cover includes a shaft passing through the muffler.

In another exemplary embodiment of the invention, the shaft cover includes a groove at its contact portion with the second rotating member.

In another exemplary embodiment of the invention, the compressor further comprises a mechanical seal installed between the shaft cover and the second rotating member for rotatably supporting the shaft cover.

In another exemplary embodiment of the invention, the suction chamber of the muffler includes a suction port, with the suction chamber being communicated with an interior space of the hermetic container.

In another exemplary embodiment of the invention, provided between the muffler and the shaft cover is a discharge guide passage for communicating between the discharge chamber of the muffler and the shaft of the shaft cover.

In another exemplary embodiment of the invention, the discharge guide passage of the muffler and the shaft cover is connected to the discharge tube by the mechanical seal.

In another exemplary embodiment of the invention, the bearing member comprises a first bearing in contact with an outer circumferential surface of the second axis of rotation, a second bearing in contact with one side of the second rotating member in the axial direction, and third and fourth bearings in contact with an inner circumferential surface of the first rotating member and one side of the first rotating member in the axial direction, respectively.

In another exemplary embodiment of the invention, the third bearing is in contact with an inner circumferential surface of the cover, and the fourth bearing is in contact with one side of the cover in the axial direction, respectively.

Yet another aspect of the present invention provides a compressor, comprising: a hermetic container including a suction tube and a discharge tube; a stator secured within the hermetic container; a first rotating member rotating by a rotating electromagnetic field from the stator, about a first axis of rotation, with the first rotating member including a suction port and a discharge port formed in one side in an axial direction and providing a compression chamber; a second rotating member rotating about a second axis of rotation within the first rotating member by a rotational force transferred from the first rotating member and compressing refrigerant in a compression chamber; a vane dividing the compression chamber into a suction region where refrigerant is sucked in and a compression region where the refrigerant is compressed/discharged from, with the vane transferring the rotational force from the first rotating member to the second rotating member; and a muffler including a suction chamber communicated with the suction port of the first rotating member, and a discharge chamber communicated with the discharge port of the first rotating member.

In yet another exemplary embodiment of the invention, the first rotating member comprises a cylinder shape rotating member, a shaft cover for covering one side of the cylinder shape rotating member, with the shaft including a suction port, a discharge port, and a shaft, and a cover for covering the other side of the cylinder shape rotating member.

In yet another exemplary embodiment of the invention, the shaft of the shaft cover includes a discharge guide passage for guiding refrigerant discharged from the discharge port.

In yet another exemplary embodiment of the invention, the discharge chamber of the muffler is communicated with the discharge port and the discharge guide passage of the shaft cover.

In yet another exemplary embodiment of the invention, the suction chamber is communicated with an interior space of the hermetic container and the suction port of the shaft cover.

Advantageous Effects

The compressor having the above configuration in accordance with the present invention is advantageous in that it not only enables compact design with a minimal height and reduced size of the compressor by radially arranging the compression mechanism and the electromotive mechanism to define the compression chamber inside the compressor by the rotor of the electromotive mechanism, but it also minimizes frictional loss on account of a substantially reduced relative velocity difference between the first rotating member and the second rotating member by compressing refrigerant in the compression chamber between them through the rotational force that is transferred to the second rotating member from the first rotating member to rotate together, thereby maximizing the compressor efficiency.

Moreover, since the vane defines the compression chamber as it reciprocates between the first rotating member and the second rotating member, without necessarily making a sliding contact with the first rotating member or the second rotating member, a refrigerant leak within the compression chamber can be minimized with the simple structure, thereby maximizing the compressor efficiency.

In addition, because refrigerant is sucked into the compression chamber through the shaft cover and discharged through the discharge tube connected to the shaft of the shaft cover, even if both the first rotating member and the second rotating member are rotating continuous suction/discharge of refrigerant into/from the compression chamber is achieved.

Furthermore, because refrigerant is sucked in through the muffler communicated with the suction port of the shaft cover, and discharged through the discharge tube via the muffler and the discharge guide passage of the shaft, noise level during the refrigerant suction/discharge can be reduced.

MODE FOR THE INVENTION

Hereinafter, preferred embodiments of the present invention will be described in detail with reference to the accompanying drawings.

Figure 1:
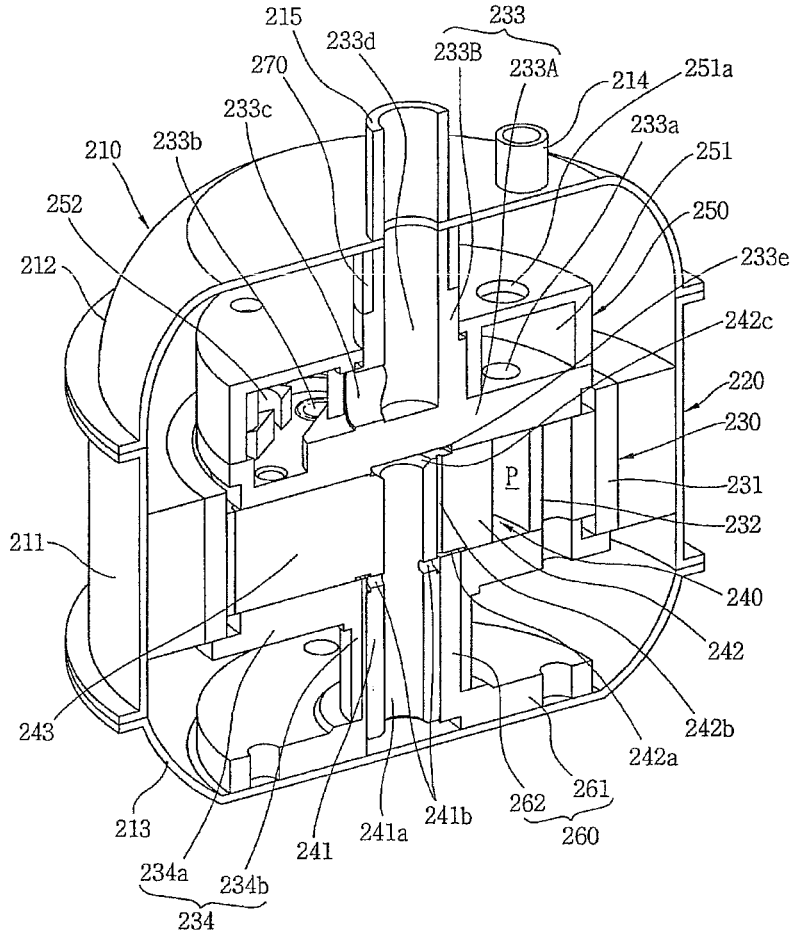
FIG. 1 is a transverse cross-sectional view showing a compressor in accordance with one embodiment of the present invention.
Figure 2:
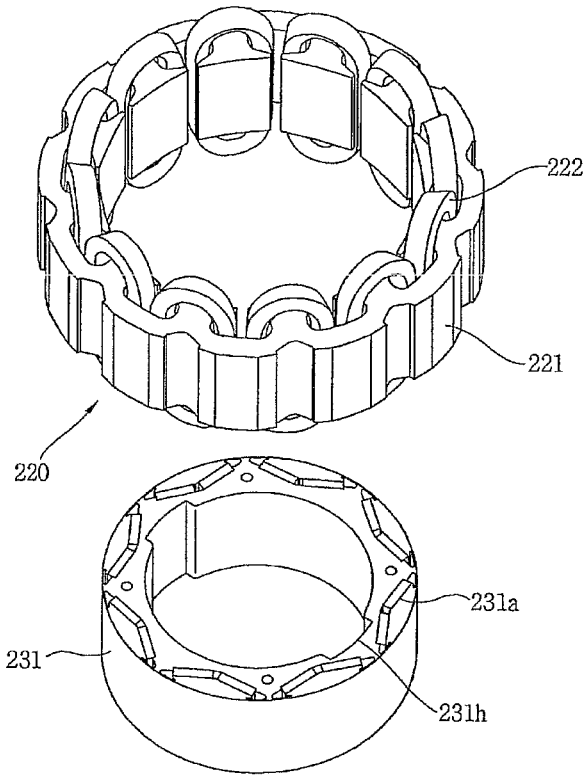
FIG. 2 is an exploded perspective view showing one example of an electric motor of a compressor in accordance with one embodiment of the present invention.
Figure 3:
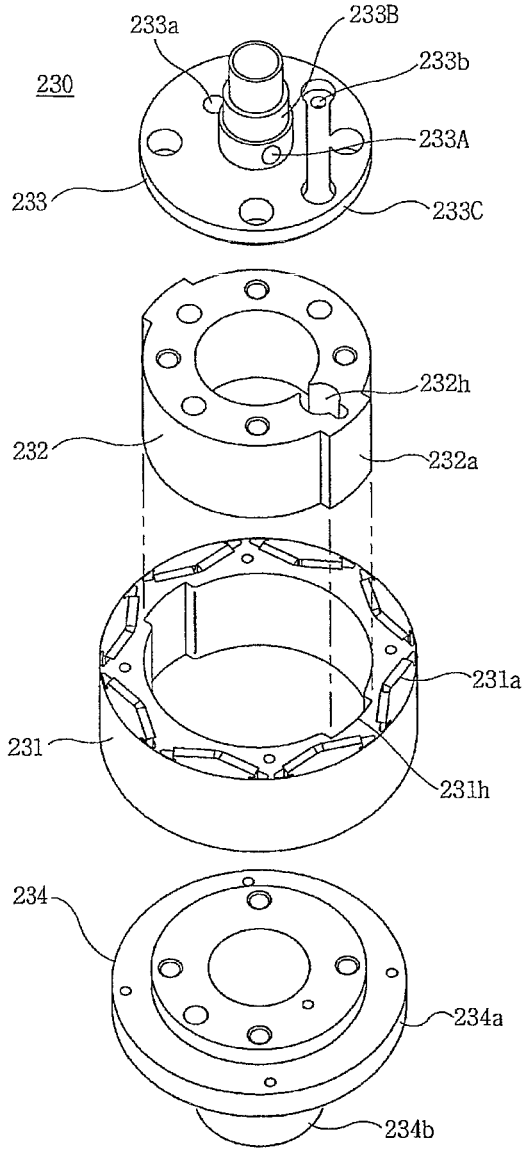
FIGS. 3 through 5 each illustrate an exploded perspective view showing one example of a compression mechanism part of a compressor in accordance with one embodiment of the present invention.
Figure 4:
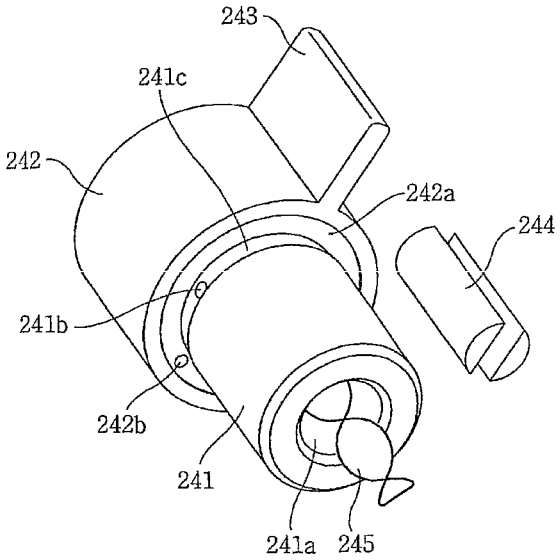
Figure 5:
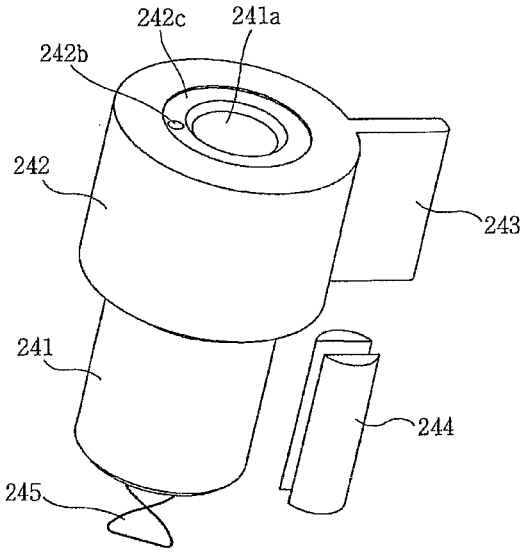

FIG. 1 is a transverse cross-sectional view showing a compressor in accordance with one embodiment of the present invention, FIG. 2 is an exploded perspective view showing one example of an electric motor of the compressor in accordance with one embodiment of the present invention, and FIGS. 3 through 5 each illustrate an exploded perspective view showing one example of a compression mechanism part of the compressor in accordance with one embodiment of the present invention.

As shown in FIG. 1, a compressor in accordance with one embodiment of the present invention includes a hermetic container 210, a stator 220 installed within the hermetic container 210, a first rotating member 230 installed within the stator 220 and rotating with an interaction with the stator 220, a second rotating member 240 rotating within the first rotating member 230 by a rotational force transferred from the first rotating member 230 for compressing refrigerant therebetween, a muffler 250 for guiding refrigerant suction/discharge to a compression chamber P between the first and second rotating members 230 and 240, a bearing 260 supporting the first and second rotating members 230 and 240 to be able to rotate within the hermetic container 210, and a mechanical seal 270. Here, an electromotive mechanism part which provides power through an electrical reaction employs, for example, a BLDC motor including the stator 220 and the first rotating member 230, and a compression mechanism part includes the first and second rotating members 230 and 240, the muffler 250, the bearing 260 and the mechanical seal 270. Therefore, by increasing inner diameter of the electromotive mechanism part instead of reducing its height, the compression mechanism part can be arranged within the electromotive mechanism part, thereby lowering the total height of the compressor. Although the embodiment of the present invention describes a so-called inner rotor type having the compression mechanism part on the inside of the electromotive mechanism part as an example, any person of ordinary skill in the art would easily find out that the general ideal described above can also be applied conveniently to a so-called outer rotor type having the compression mechanism part on the outside of the electromotive mechanism part.

The hermetic container 210 is composed of a cylinder-shaped body 211, and upper/lower shells 212 and 213 coupled to the top/bottom of the body 211 and stores oil at a suitable height to lubricate or smooth the first and second rotating members 230 and 240 (see FIG. 1). The upper shell 212 includes a suction tube 214 at a predetermined position for sucking refrigerant and a discharge tube 215 at another predetermined position for discharging refrigerant. Here, whether a compressor is a high-pressure type compressor or a low-pressure type compressor is determined depending on whether the interior of the hermetic container 210 is filled with compressed refrigerants or pre-compressed refrigerants, and the position of the suction tube 214 and discharge tube 215 should be determined based on that. Referring to FIG. 1, the first embodiment of the present invention introduces a low pressure compressor. To this end, the suction tube 214 is connected to the hermetic container 210 and the discharge tube 215 is connected to the compression mechanism part. Thus, when a low-pressure refrigerant is sucked in through the suction tube 214, it fills the interior of the hermetic container 210 and flows into the compression mechanism part through the suction tube 215. In the compression mechanism part, the low-pressure refrigerant is compressed to high pressure and then exits outside through the discharge tube 215 via the discharge chamber of the muffler 250. In another example, it is also possible to construct a compressor without the hermetic container 210 but having the suction tube 214 and the discharge tube 215 inserted into the compression mechanism part or the muffler 250 to allow refrigerant to get directly sucked into the compression mechanism part through the suction chamber only and to be directly discharged from the compression mechanism part through the discharge chamber only. In this case, however, it is desirable to install an accumulator at the same time of the installation of the compressor so as to separate liquid refrigerant and provide the refrigerant to the compression mechanism part in a stable manner.

The stator 220, as shown in FIG. 2, is composed of a core 221, and a coil 222 primarily wound around the core 221. While a core used for a conventional BLDC motor has 9 slots along the circumference, the core 221 of a BLDC motor has 12 slots along the circumference because the stator in a preferred embodiment of the present invention has a relatively a large diameter. Considering that a coil winding number increases with an increasing number of core slots, in order to generate an electromagnetic force of the conventional stator 220, the core 221 may have a smaller height.

The first rotating member 230, as shown in FIG. 3, is composed of a rotor 231, a cylinder 232, a first cover 233 and a second cover 234. The rotor 231 has a cylindrical shape, with the rotor 231 rotating within the stator 220 (see FIG. 1) by a rotating electromagnetic field generated from the stator 220 (see FIG. 1), and inserted therethrough are plural permanent magnets 231*a* in an axial direction to generate a rotating magnetic field. Similar to the rotor 231, the cylinder 232 also takes the form of a cylinder to create a compression chamber P (see FIG. 1) inside. The rotor 231 and the cylinder 232 can be manufactured separately and joined together later. In one example, a pair of mount protrusions 232*a* is arranged at the outer circumferential surface of the cylinder 232, and grooves 231*h* having a corresponding shape to the mount protrusions 232*a* of the cylinder 232 are formed in the inner circumferential surface of the rotor 231 such that the outer circumferential surface of the cylinder 232 is engaged with the inner circumferential surface of the rotor 231. More preferably, the rotor 231 is integrally formed with the cylinder 232, with the permanent magnets 231*a* mounted in holes that are additionally formed in the axial direction.

The first cover 233 and the second cover 234 are coupled to the rotor 231 and/or the cylinder 232 in the axial direction, and the compression chamber P (see FIG. 1) is defined between the cylinder 232 and the first and second covers 233 and 234. The first cover 233 is composed of a planar shape cover portion 233A for covering the upper surface of the roller 242, and an upwardly projecting hollow shaft 233B at the center. The cover portion 233A of the first cover 233 includes a suction port 233*a* for sucking in refrigerant therethrough, a discharge port 233*b* for discharging a compressed refrigerant therethrough from the compression chamber P, and a discharge valve (not shown) mounted thereon. The shaft 233B of the first cover 233 includes discharge guide passages 233*c* and 233*d* for guiding refrigerant to the outside of the hermetic container 210, with the refrigerant having been discharged through the discharge port 233*b* of the first cover 233. Also, the shaft 233B is designed to be inserted into the mechanical seal 270 by forming part of its outer circumferential surface at the tip. The discharge guide passages 233*c* and 233*d* are composed of a first discharge guide passage 233*d* which is formed along the axial direction of the shaft 233B, and a second discharge guide passage 233*c* which extends from the first discharge guide passage 233*d* towards the discharge chamber 252 of the muffler 250. Similar to the first cover 233, the second cover 234 is composed of a planar shape cover portion 234*a* for covering the lower surface of the roller 242, and a downwardly projecting hollow shaft 234*b* at the center. Although the hollow shaft 234*b* may be optionally omitted, its role in receiving a load acting thereon increases a contact area with the bearing 260 and give more stable support to the second cover 234. Since the first and second covers 233 and 234 are bolt-fastened to the rotor 231 or the cylinder 232 in the axial direction, the rotor 231, the cylinder 232, and the first and second covers 233 and 234 rotate together as one unit.

Figure 6:
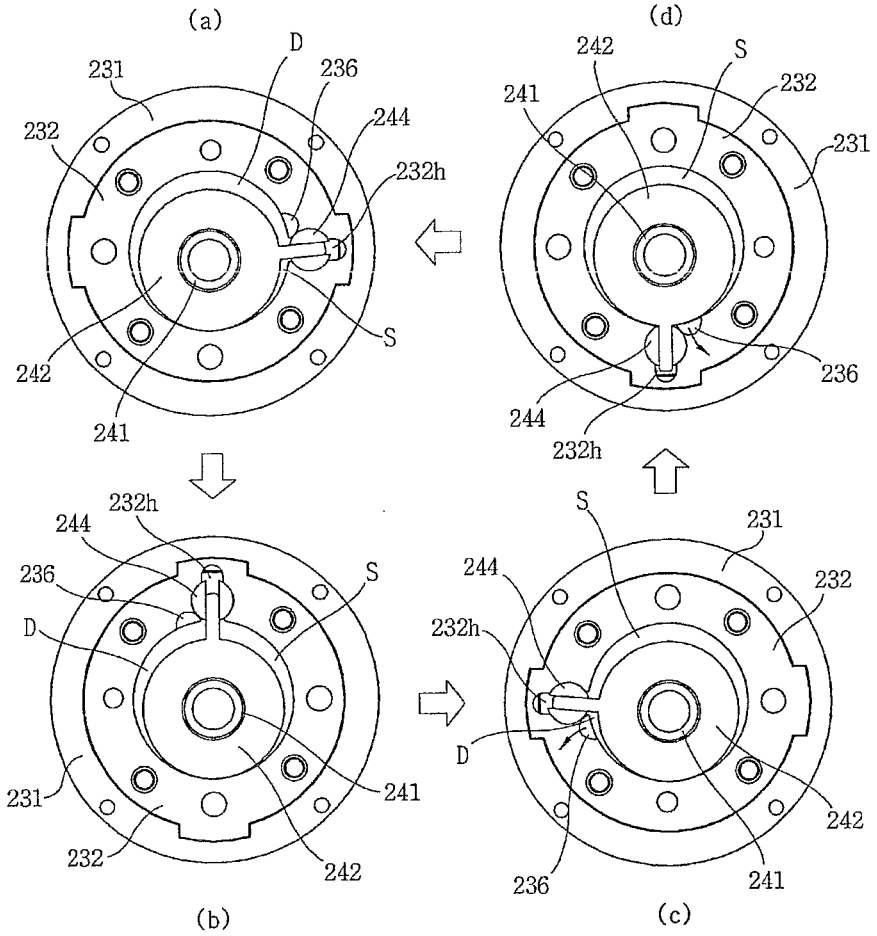
FIG. 6 is a plan view showing one example of a vane mount structure adopted to a compressor in accordance with one embodiment of the present invention.

The second rotating member 240, as shown in FIGS. 4 and 5 includes a rotational shaft 241, a roller 242, and a vane 243. The rotational shaft 241 is protrusively formed towards one side, i.e., lower surface, in the roller 242 axis direction. In so doing the upper surface of the second rotating member 240 is completely covered with the first cover 233. Because the rotational shaft 241 according to the embodiment is protruded only from the lower surface of the roller 242, the protruded length of the rotational shaft 241 from the lower surface of the roller 242 as illustrated in the second embodiment is preferably longer than the protrude length of the rotational shaft 241 which is extended in the roller axis direction from both surface of the roller, to more stably support the motion of the second rotating member. Also, even if the rotational shaft 241 and the roller 242 may have been manufactured separately, they must join together to be able to rotate as one unit. The rotational shaft 241 takes the form of a hollow shaft passing through the inside of the roller 242, with the hollow being composed of an oil feeder 241*a* for pumping oil. As the upper surface of the rotational shaft 241 is covered with the first cover 233, it is better to arrange the passage heading for the compression chamber P or the refrigerant suction/discharge passages separately from the passage of the oil feeder 241*a* for pumping oil such that the mixing of oil and refrigerant can be minimized. The oil feeder 241*a* of the rotational shaft 241 is provided with a helical member 245 to assist oil ascending by a rotational force, or a groove to assist oil ascending by a capillary phenomenon. The rotational shaft 241 and the roller 242 each have all kinds of oil feed holes 241*c* and oil storage cavities 241*d* for supplying oil from the oil feeder 241*a* into between two or more members subject to sliding interactions. The roller 242 takes the form of a hollow shaft to receive the rotational shaft 241 therethrough. The vane 243 is formed on the outer circumference surface of the roller 242, with the vane 243 being disposed to extend radially and rotate at a preset angle while making a linear reciprocating motion, along bushes 244, within a vane mount slot 232*h* (see FIG. 6) of the first rotating member 230 (see FIG. 1). As shown in FIG. 6, a couple of bushes 244 limits the circumferential rotation of the vane 243 to below a preset angle and guides the vane to make a linear reciprocating motion through a space defined between the couple of bushes 244 that are mounted within the vane mount slot 232*h* (see FIG. 6). Even though oil may be supplied to enable the vane 243 to attain successful lubrication while reciprocating linearly within the bushes 244, it is also possible to make the bushes 244 of natural-lubricating materials. For example, the bushes 244 can be manufactured in use of a suitable material sold under the trademark of Vespel SP-21. Vespel SP-21 is a polymer material which combines excellent wear resistance, heat resistance, natural lubricity, flame resistance, and electrical insulation.

FIG. 6 is a plan view showing a vane mount structure and a running cycle of the compression mechanism part in a compressor according to the present invention.

To explain the mount structure of the vane 243 with reference to FIG. 6, a vane mount slot 232*h* is formed axially and longitudinally in the inner peripheral surface of the cylinder 232, and a couple of bushes 244 fit into the vane mount slot 132*h*, and the vane 243 integrally formed with the rotational shaft 241 and the roller 242 is inserted between the bushes 244. The cylinder 232 and the roller 242 define the compression chamber P (see FIG. 1) between them, with the compression chamber P (see FIG. 1) being divided by the vane 243 and by a contact portion 'c' between the cylinder 232 and the roller 242 into a suction region S and a discharge region D. The suction passages 233*a* (see FIG. 1) of the first cover 233 (see FIG. 1) are positioned in the suction region S, and the discharge port 233*b* (see FIG. 1) of the first cover 233 (see FIG. 1) is positioned in the discharge region D, with the suction passages 233*a* (see FIG. 1) of the first cover 233 (see FIG. 1) and the discharge port 233B (see FIG. 1) of the first cover 233 (see FIG. 1) being disposed to communicate with a discharge incline portion 236 contiguous with the vane 243. Therefore, the vane 243 which is integrally manufactured with the roller 242 in the present invention compressor and assembled to slidably movable between the bushes 244 can more effectively reduce frictional loss caused by the sliding contact and lower a refrigerant leak between the suction region S and the discharge region D more than a spring-supported vane which is manufactured separately from the roller or the cylinder in a conventional rotary compressor.

At this time, the rotation of the cylinder shape rotors 231 and 232 is transferred to the vane 243 formed at the second rotating member 240 so as to rotate the rotating member, and the bushes 244 inserted into the vane mount slot 132*h* oscillate, thereby enabling the cylinder shape rotors 231 and 232 and the second rotating member 240 to rotate together. While the cylinder 232 and the roller 242 rotate, the vane 243 makes a relatively linear reciprocating motion with respect to the vane mount slot 232*h* of the cylinder 232.

Therefore, when the rotor 231 receives a rotational force derived from the rotating electromagnetic field of the stator 220 (see FIG. 1), the rotor 231 and the cylinder 232 rotate. With the vane 243 being inserted into the cylinder 232, the rotational force of the rotor 231 and the cylinder 232 is transferred to the roller 242. Along the rotation of both, the vane 243 then linearly reciprocates between the bushes 244. That is, the rotor 231 and the cylinder 232 each have an inner surface corresponding to the outer surface of the roller 242, and these corresponding portions are repeatedly brought into contact with and separate from each other per rotation of the rotor 231/cylinder 232 and the roller 242. In so doing the suction region S gradually expands and refrigerant or a working fluid is sucked into it, while the discharge region D gradually shrinks at the same time to compress the refrigerant or working fluid therein and discharge it later.

To see how the suction, compression and discharge cycle of the compression mechanism part works, FIG. 6*a* shows a step of sucking refrigerant or a working fluid into the suction region S. For instance, a working fluid is being sucked in and immediately compressed in the discharge D. When the first and second rotating members 230 and 240 are arranged as shown in FIG. 6*b*, the working fluid is continuously sucked into the suction region S and compressed proceeds accordingly. When the first and second rotating members 230 and 240 are arranged as shown in FIG. 6*c*, the working fluid is continuously sucked in, and the refrigerant or the working fluid of a preset pressure or higher in the discharge region D is discharged through the discharge incline portion (or discharge port) 236. Lastly, when the first and second rotating members 230 and 240 are arranged as shown in FIG. 6*d*, the compression and discharge of the working fluid are finished. In this way, one cycle of the compression mechanism part is completed.

Figure 7:
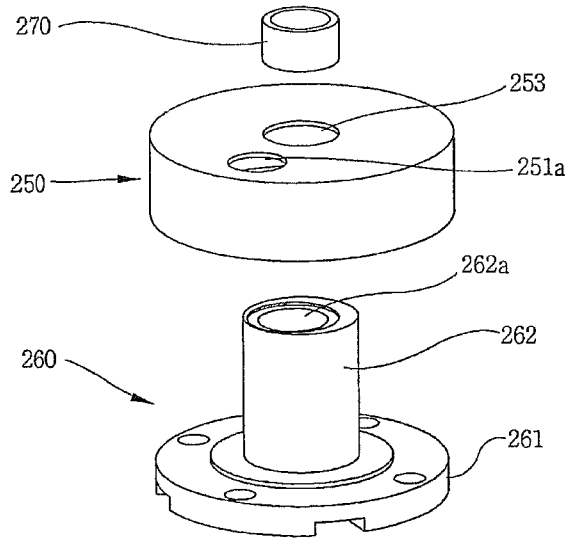
FIG. 7 is an exploded perspective view showing one example of a support member in the compressor in accordance with one embodiment of the present invention.

FIG. 7 is an exploded perspective view showing an example of a support member of the compressor in accordance with the present invention.

As shown in FIGS. 1 and 7, the first and second rotating members 230 and 240 described earlier are rotatably supported on the inside of the hermetic container 210 by the bearing 260 and the mechanical seal 270 that are coupled in the axial direction. The bearing 260 is bolt-fastened to the lower shell 213, and the mechanical seal 270 is secured to the inside of the hermetic container 210 by welding or the like in communication with the discharge tube 215 of the hermetic container 210.

The mechanical seal 270 is a device for preventing a fluid leak because of the contact between a rapidly spinning shaft and a fixed element/rotatory element in general, and is disposed between the discharge tube 215 of the stationary hermetic container 210 and the rotating shaft 233B of the first cover 233. Here, the mechanical seal 270 rotatably supports the first cover within the hermetic container 210 and communicates the shaft 233B of the first cover 233 with the discharge tube 215 of the hermetic container 210, while preventing a refrigerant leak between them.

The bearing 260 is constructed to adopt a journal bearing for rotatably supporting the outer peripheral surface of the rotational shaft 241 and the inner peripheral surface of the second cover 234, and a trust bearing for rotatably supporting the lower surface of the roller 242 and the lower surface of the second cover 234. The bearing 260 is composed of a planar shape support 261 that is bolt-fastened to the lower shell 213, and a shaft 262 disposed at the center of the support 261, with the shaft having an upwardly protruded hollow 262*a* (see FIG. 12). At this time, the center of the hollow 262*a* of the bearing 260 is formed at a position eccentric from the center of the shaft 262 of the bearing 260, or may be collinear with the center of the shaft 262 of the bearing 260 depending on whether the roller 242 is formed eccentric.

Figure 8:
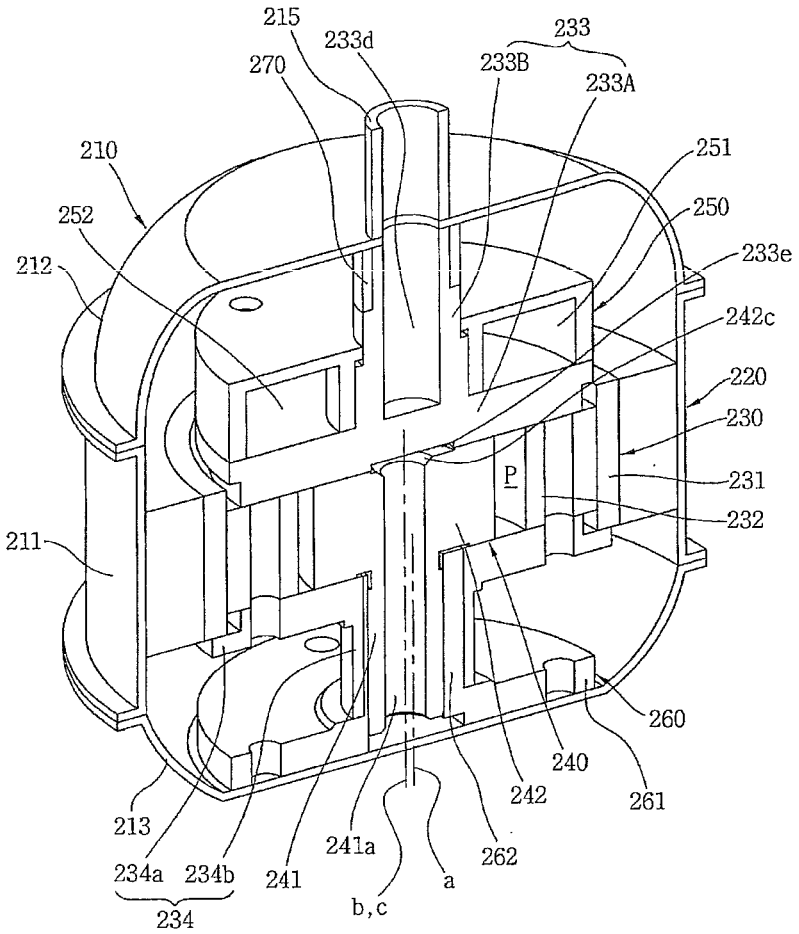
FIGS. 8 through 10 each illustrate a transverse cross-sectional view showing a rotation centerline of a compressor in accordance with one embodiment of the present invention.
Figure 9:
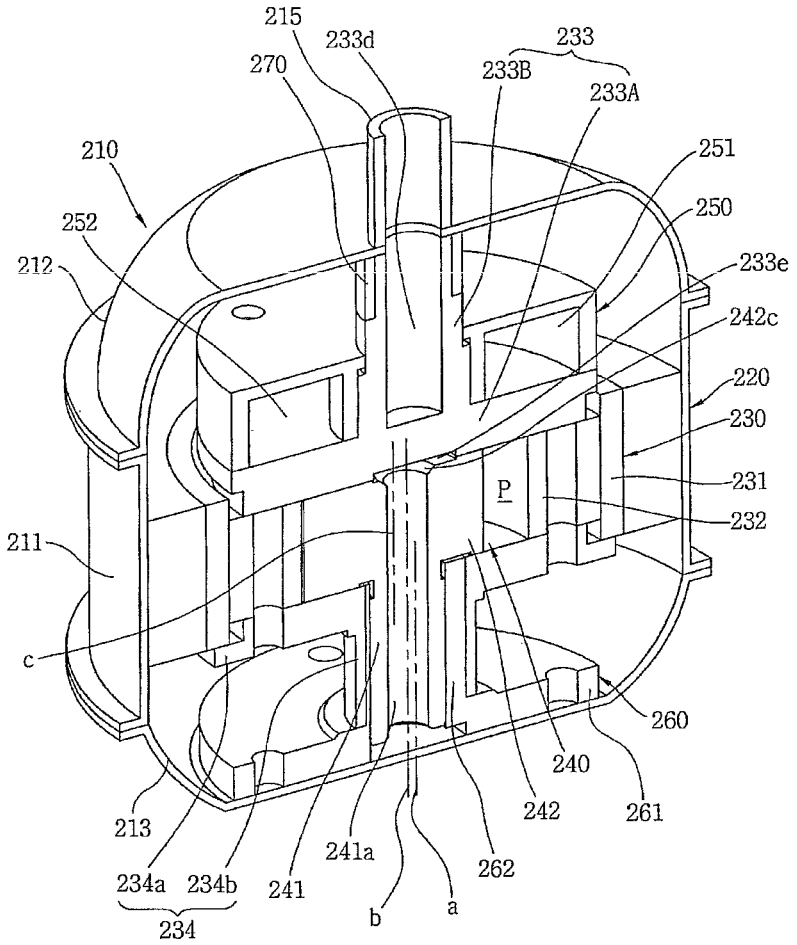
Figure 10:
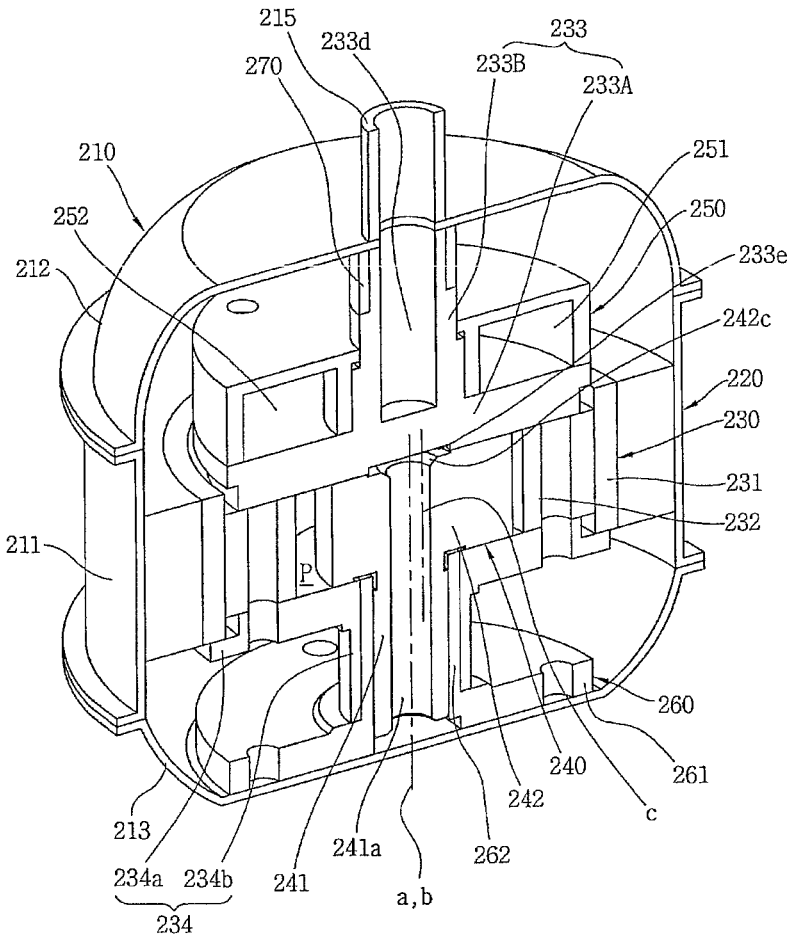

FIGS. 8 through 10 each illustrate a transverse cross-sectional view showing a rotation centerline of the compressor in accordance with one embodiment of the present invention.

To enable the first and second rotating members 230 and 240 to compress refrigerant while rotating the second rotating member 240 is positioned eccentric with respect to the first rotating member 230. One example of relative positioning of the first and second rotating members 230 and 240 is illustrated in FIGS. 8 through 10. In the drawings, 'a' indicates a centerline of the first axis of rotation of the first rotating member 230, or it may be regarded as a longitudinal centerline of the shaft 234*b* of the second cover 234, or a longitudinal centerline of the shaft 262 of the bearing 260. Here, because the first rotating member 230 includes the rotor 231, the cylinder 232, the first cover 233 and the second cover 234 as shown in the first embodiment, with all the elements rotating together en bloc, 'a' may be regarded as the rotation centerline of them, 'b' indicates a centerline of the second axis of rotation of the second rotating member 240 or a longitudinal centerline of the rotational shaft 241, and 'c' indicates a longitudinal centerline of the second rotating member 240 or a longitudinal centerline of the roller 242.

FIG. 8 shows that the centerline 'b' of the second axis of rotation is spaced apart a predetermined distance from the centerline 'a' of the first axis of rotation, and the longitudinal centerline 'c' of the second rotating member 240 is collinear with the centerline 'b' of the second axis of rotation. In this way, the second rotating member 240 is disposed eccentric with respect to the first rotating member 230, and when the first and second rotating members 230 and 240 rotate together by the medium of the vane 243, they repeatedly contact, separate, and retouch per rotation as explained before, thereby compressing refrigerant within the compression chamber P.

FIG. 9 shows that the centerline 'b' of the second axis of rotation is spaced apart a predetermined distance from the centerline 'a' of the first axis of rotation, and the longitudinal centerline 'c' of the second rotating member 240 is spaced apart a predetermined distance from the centerline 'b' of the second axis of rotation, but the centerline 'a' of the first axis of rotation and the longitudinal centerline 'c' of the second rotating member 240 are not collinear. Similarly, the second rotating member 240 is disposed eccentric with respect to the first rotating member 230, and when the first and second rotating members 230 and 240 rotate together by the medium of the vane 243, they repeatedly contact, separate, and retouch per rotation as explained before in the first embodiment, thereby compressing refrigerant within the compression chamber P.

FIG. 10 shows that the centerline 'b' of the second axis of rotation is collinear with the centerline 'a' of the first axis of rotation, and the longitudinal centerline 'c' of the second rotating member 240 is spaced apart a predetermined distance from the centerline 'a' of the first axis of rotation and from the centerline 'b' of the second axis of rotation. Similarly, the second rotating member 240 is disposed eccentric with respect to the first rotating member 230, and when the first and second rotating members 230 and 240 rotate together by the medium of the vane 243, they repeatedly contact, separate, and retouch per rotation as explained before in the first embodiment, thereby compressing refrigerant within the compression chamber P.

Figure 11:
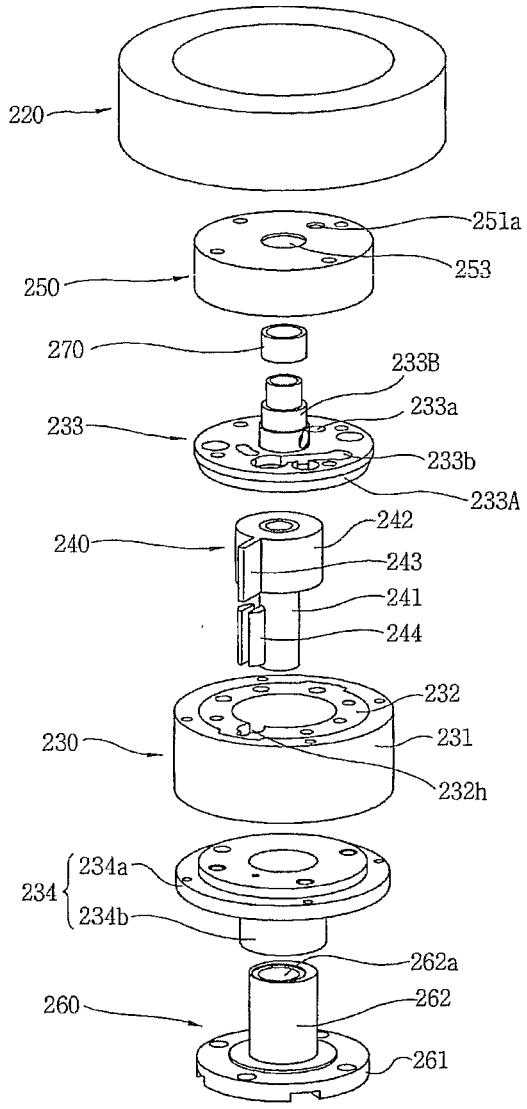
FIG. 11 is an exploded perspective view showing a compressor in accordance with one embodiment of the present invention.

FIG. 11 is an exploded perspective view showing a compressor in accordance with the one embodiment of the present invention.

To see an example of how the compressor according to one embodiment of the present invention is assembled by referring to FIGS. 1 and 11, the rotor 231 and the cylinder 232 are either manufactured separately and then coupled, or manufactured in one unit from the beginning. The rotational shaft 241, the roller 242 and the vane 243 can also be manufactured separately or integrally, but either way, they should be able to rotate as one unit. The vane 243 is inserted between the bushes 244 within the cylinder 231. Overall, rotational shaft 241, the roller 242 and the vane 243 are mounted within the rotor 231 and the cylinder 232. The first and second covers 233 and 234 are bolt-fastened in the axial direction of the rotor 231 and the cylinder 232, with the first cover 233 covering the upper surface of the roller 242 while the second cover 234 covering the roller 242 even if the rotational shaft 241 may pass through the second cover 234. In addition, the muffler 250 is bolt-fastened in the axial direction of the first cover 233, with the shaft 233B of the first cover 233 fitting into a shaft cover mount hole 253 of the muffler 250 to pass through the muffler 250. To prevent a refrigerant leak between the first cover 233 and the muffler 250, a separate sealing member (not shown) may be provided additionally to the joint area between the first cover 233 and the muffler 250. The inside of the muffler 250 is divided into a suction chamber 251 having a suction port 251*a*, and a discharge chamber 252 formed in communication with the discharge guide passage 233*d* of the shaft cover 233, so the muffler 250 should be assembled in a manner that the suction chamber 251 and the discharge chamber 252 are located in corresponding positions of the suction port 233*a* and the discharge port 233*b* of the first cover 233, respectively.

After a rotation assembly assembled with the first and second rotating members 230 and 240 are put together as described above, the bearing 260 is bolt-fastened to the lower shell 213, and the rotation assembly is then assembled to the bearing 260, with the inner circumferential surface of the shaft 234*a* of the second cover 234 circumscribing the outer circumferential surface of the shaft 262 of the bearing 260, with the outer circumferential surface of the rotational shaft 241 being inscribed in the hollow 262*a* of the bearing 260. Next, the stator 220 is press fitted into the body 211, and the body 211 is joined to the upper shell 212, with the stator 220 being positioned to maintain an air-gap with the outer circumferential surface of the rotation assembly. After that, the mechanical seal 270 is assembled within the upper shell 212 in a way that it is communicated with the discharge tube 215, and the upper shell 212 having the mechanical seal 270 being secured thereon is joined to the body 211, with the mechanical seal 270 being inserted into a stepped portion on the outer circumferential surface of the shaft 233B of the first cover 233. Of course, the mechanical seal 270 is assembled to enable the communication between the shaft 233B of the first cover 233 and the discharge tube 215 of the upper shell 212.

Therefore, with all of the rotation assembly assembled with the first and second rotating members 230 and 240, the body 211 mounted with the stator 220, the upper shell 212 mounted with the mechanical seal 270, and the lower shell 213 mounted with the bearing 260 being joined in the axial direction, the mechanical seal 270 and the bearing 260 rotatably support the rotation assembly onto the hermetic container 210 in the axial direction.

Figure 12:
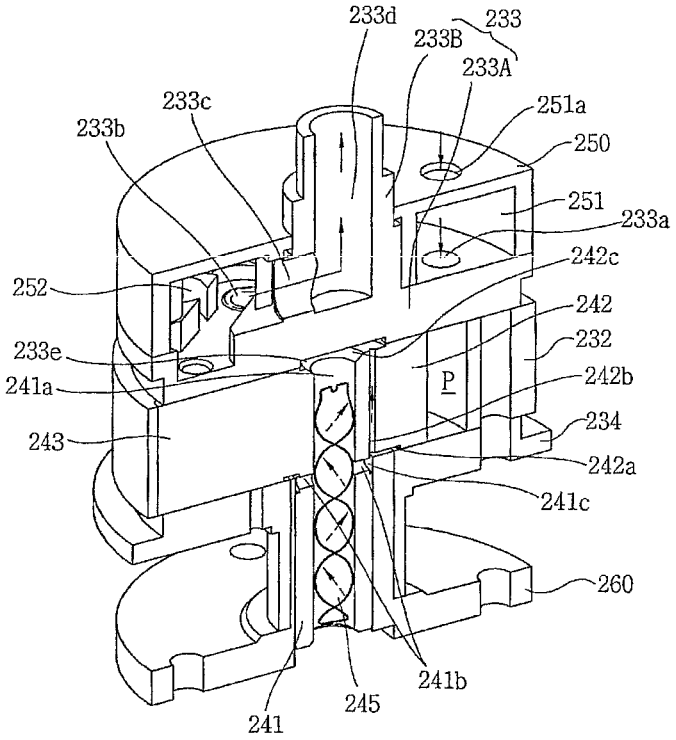
FIG. 12 is a transverse cross-sectional view showing how refrigerant and oil flow in a compressor in accordance with one embodiment of the present invention.

FIG. 12 is a transverse cross-sectional view showing how refrigerant and oil flow in a compressor in accordance with one embodiment of the present invention.

To see how the embodiment of the compressor of the present invention operates by referring to FIGS. 1 and 12, when electric current is fed to the stator 220, a rotating electromagnetic field is generated between the stator 220 and the rotor 231, and with the application of a rotational force from the rotor 231, the first rotating member 230, i.e., the rotor 231 and the cylinder 232, and the first and second covers 233 and 234 rotate together as one unit. As the vane is 234 is installed at the cylinder 231 to be able to linearly reciprocate, a rotational force of the first rotating member 230 is transferred to the second rotating member 240 so the second rotating member 240, i.e., the axis of rotation 241, the roller 242 and the vane 243, rotate together as one unit. As shown in FIGS. 8 through 10, because the first and second rotating members 230 and 240 are disposed eccentric with respect to each other, they repeatedly contact, separate, and retouch per rotation, thereby varying the volume of the suction region S/the discharge region D divided by the vane 243 so as to compress refrigerant within the compression chamber P and to pump oil at the same time to lubricate between two slidingly contacting members.

When the first and second rotating members 230 and 240 rotate by the medium of the vane 243, refrigerant is sucked in, compressed and discharged. In more detail, the roller 242 and the cylinder 232 repeatedly contact, separate, and retouch during the motion of the rotating members, thereby varying the volume of the suction region S/the discharge region D divided by the vane 243 so as to suck in, compress, and discharge refrigerant. That is to say, as the volume of the suction region gradually expands along the rotation of both, refrigerant is sucked into the suction region of the compression chamber P through the suction tube 214 of the hermetic container 210, the interior of the hermetic container 210, the suction port 251*a* and suction chamber 251 of the muffler 250, and the suction port 233*a* of the first cover 233. Concurrently, as the volume of the discharge region gradually shrinks along the rotation of both, refrigerant is compressed, and when the discharge valve (not shown) is open at a pressure above the preset level the compressed refrigerant is then discharged outside of the hermetic container 210 through the discharge port 233*b* of the first cover 233, the discharge chamber 252 of the muffler 250, the discharge passages 233*c* and 233*d* of the first cover 233, and the discharge tube 215 of the hermetic container 210. Needless to say, noise level is reduced as the high-pressure refrigerant passes through the discharge chamber 252 of the muffler 250.

When the discharge valve (not shown) is open at a pressure above a preset level, refrigerant starts to be discharged from the discharge region and the discharge continues until the contact portion 'c' (see FIG. 6) between the roller 242 and the cylinder 232 overlaps with the discharge port 233B of the first cover 233. Meanwhile, sometimes the position of the contact portion between the roller 242 and the cylinder 232 overlaps with the position of the vane 243, and this makes the division in the suction region and the discharge region disappear and creates one region in the entire compression chamber P instead. But the very next moment the position of the contact portion between the roller 242 and the cylinder 232 and the position of the vane 243 change on account of the rotation of the first and second rotating members 230 and 240, and the compression chamber P is again divided into a volume-expanding suction region S and a volume-shrinking discharge region D. A refrigerant having been sucked in through the suction region S in a previous rotation is compressed in the discharge region in a subsequent rotation. The time when the refrigerant location changes from the suction region S to the discharge region D presumably coincides with the time when the position of the contact portion between the roller 242 and the cylinder 232 overlaps with the position of the vane 243.

The change in volume of the suction and discharge regions is due to differences in relative positioning of the contact portion between the roller 242 and the cylinder 232 and of the position of the vane 243, so the suction port 233*a* of the first cover 233 and the discharge port 233*b* of the first cover 233 must be disposed opposite from each other with respect to the vane 243. In addition, suppose that the first and second rotating members 230 and 240 rotate in a counterclockwise direction. Then the contact portion between the roller 242 and the cylinder 232 will shift in a clockwise direction with respect to the vane 243. Thus, the discharge port 236 of the cylinder 232 should be positioned on more front side than the vane 243 in the rotation direction, and the suction passage 242*a* of the roller 242 should be positioned on more rear side than the vane 243. Meanwhile, the suction passage 242*a* of the roller 242 and the discharge port 236 of the cylinder 232 should be formed as close as possible to the vane 243 so as to reduce dead volume of the compression chamber P which is useless for actual compression of the refrigerant.

Moreover, during the rotation of the first and second rotating members 230 and 240, oil is supplied to sliding contact portions between the bearing 260 and the first and second rotating members 230 and 240 to lubricate between the members. To this end, the rotational shaft 241 is dipped into the oil that is stored at the lower area of the hermetic container 210, and any kind of oil feed passage for oil supply is provided to the second rotating member 240. In more detail, when the rotational shaft 241 starts rotating in the oil stored at the lower area of the hermetic container 210, the oil pumps up or ascends along the helical member 245 or groove disposed within an oil feeder 241*a* of the rotational shaft 241 and flows out through an oil feed hole 241*b* of the rotational shaft 241, not only to gather up at an oil storage cavity 241*c* between the rotational shaft 241 and the bearing 260 but also to lubricate between the rotational shaft 241, the roller 242, the bearing 260, and the second cover 234. Also, the oil having been gathered up at the oil storage cavity 241*c* between the rotational shaft 241 and the bearing 260 pumps up or ascends through the oil feed hole 242*b* of the roller 242, not only to gather up at oil storage cavities 233*e* and 242*c* between the rotational shaft 241, the roller 242 and the first cover 233 but also to lubricate between the rotational shaft 241, the roller 242, the first cover 233. In the embodiment, the roller 242 may not necessarily have the oil feed hole 242*b* because the oil feeder 242*a* can extend as high as the contact portion between the roller 242 and the first cover 233 to enable direct oil supply to the oil storage cavities 233*e* and 242*c* therethrough. Besides, the oil may also be fed between the vane 243 and the bush 244 through an oil groove or an oil hole, but, as mentioned earlier, it is better to manufacture the bush 244 out of natural lubricating materials instead.

As has been explained so far, because refrigerant is sucked in/discharged through the first cover 233 and the muffler 250 and oil is fed between the members through the rotational shaft 241 and the roller 242, the refrigerant circulating passage is isolated from the oil circulating passage on the rotational shaft 241 such that the refrigerant may not be mixed with the oil. Further, a much oil and refrigerant leak can be reduced to secure working reliability of the compressor overall.

The present invention has been described in detail with reference to the embodiments and the attached drawings. However, the scope of the present invention is not limited to the embodiments and the drawings, but defined by the appended claims.

The invention claimed is:

1. A compressor comprising:

a hermetic container;

a stator secured within the hermetic container, that generates a rotating electromagnetic field;

a cylinder type rotor that is rotated within the stator by the rotating electromagnetic field of the stator and defines a compression chamber within the cylinder type rotor;

a roller that rotates within the compression chamber of the cylinder type rotor by a rotational force transferred from the cylinder type rotor and compresses a refrigerant during rotation;

a rotational shaft that is integrally formed with the roller and protrudes from a side of the roller in an axial direction of the roller;

a vane that divides the compression chamber into a suction region, into which the refrigerant is sucked, and a compression region, in and from which the refrigerant is compressed and discharged, wherein the vane transfers the rotational force from the cylinder type rotor to the roller a first cover and a second cover that are joined to the cylinder type rotor in an axial direction of the cylinder type rotor and rotate together with the cylinder type rotor, wherein the compression chamber in which the refrigerant is compressed is defined between the cylinder type rotor, the roller, the first cover, and the second cover, wherein the first cover has a surface that faces and covers the roller, the surface including a suction port through which the refrigerant is suctioned into the compression chamber, and wherein the rotational shaft extends through the second cover; and a mechanical seal installed between the hermetic container and the first covers wherein the mechanical seal rotatably supports the first cover.

2. The compressor according to claim 1, wherein the first cover includes a cavity on the surface of the first cover that faces the roller.

3. The compressor according to claim 1, further comprising:

a muffler that is joined to the first cover in the axial direction of the cylinder type rotor and includes a suction chamber that communicates with the suction port of the first cover.

4. The compressor according to claim 3, wherein the hermetic container is connected to a suction tube and a discharge tube through which the refrigerant is suctioned and discharged, respectively, wherein the suction chamber of the muffler further comprises a suction port, and wherein the suction chamber of the muffler communicates with an interior space of the hermetic container.

5. The compressor according to claim 3, wherein the first cover includes a discharge port through which the refrigerant is discharged from the compression chamber, wherein an inside of the muffler is divided into the suction chamber and a discharge chamber, and wherein the discharge chamber of the muffler communicates with the discharge port of the first cover separately from the suction chamber of the muffler.

6. The compressor according to claim 5, wherein the first cover further includes a hollow shaft, and wherein the hollow shaft includes a discharge guide passage with which the discharge chamber of the muffler communicates.

7. The compressor according to claim 6, wherein the discharge guide passage formed in the hollow shaft comprises a first discharge guide passage formed in an axial direction of the hollow shaft, and a second discharge guide passage formed in a radial direction of the hollow shaft.

8. The compressor according to claim 6, wherein the hollow shaft is connected to a discharge tube by the mechanical seal.

9. The compressor according to claim 1, wherein the compressor further comprises a bearing member secured onto an interior of the hermetic container that rotatably supports the cylinder type rotor, the roller, and the rotational shaft.

10. The compressor according to claim 9, wherein the bearing member comprises a first bearing that contacts an outer circumferential surface of the rotational shaft, a second bearing that contacts a side of the roller in the axial direction of the roller, and third and fourth bearings that contact an inner circumferential surface of the second cover and a side of the second cover in the axial direction of the cylinder type rotor, respectively.

11. The compressor according to claim 1, wherein the suction port of the first cover is positioned at a more rear side position than the vane with respect to a rotational direction of the cylinder type rotor and the roller.

12. The compressor according to claim 5, wherein the discharge port of the first cover is positioned at a more front side position than the vane with respect to a rotational direction of the cylinder type rotor and the roller.

13. A compressor, comprising:

a hermetic container including a suction tube and a discharge tube;

a stator secured within the hermetic container, that generates a rotating electromagnetic field;

a first rotating member that is rotated by the rotating electromagnetic field of the stator about a first axis of rotation, which is collinear with a center of the stator and extends in a longitudinal direction;

a first cover, which includes a suction port and a discharge port, secured to a first side of the first rotating member in an axial direction;

a second cover secured to a second side of the first rotating member in the axial direction;

a second rotating member that rotates within the first rotating member by a rotational force transferred from the first rotating member about a second axis of rotation, wherein the second rotating member includes a rotational shaft that extends through the second cover and compresses a refrigerant in a compression chamber, which is defined between the first and second rotating members;

a vane that divides the compression chamber into a suction region, into which the refrigerant is sucked, and a compression region, in and from which the refrigerant is compressed and discharged, wherein the vane transfers the rotational force from the first rotating member to the second rotating member;

a bearing secured within the hermetic container that rotatably supports the first rotating member and the second rotating member; and a muffler joined to the first cover, that communicates with the discharge port of the first cover.

14. The compressor according to claim 13, wherein the second axis of rotation is spaced apart from the first axis of rotation.

15. The compressor according to claim 14, wherein a central longitudinal axis of the second rotating member is coaxial with the second axis of rotation.

16. The compressor according to claim 14, wherein a central longitudinal axis of the second rotating member is spaced apart from the second axis of rotation.

17. The compressor according to claim 14, wherein the second axis of rotation is coaxial with the first axis of rotation, and wherein a central longitudinal axis of the second rotating member is spaced apart from the first axis of rotation and the second axis of rotation.

18. The compressor according to claim 13, wherein the muffler comprises a suction chamber that communicates with the suction port of the first cover, and a discharge chamber that communicates with the discharge port of the first cover, wherein the discharge chamber is separately defined from the suction chamber, and wherein the first cover further includes a hollow shaft that passes through the muffler.

19. The compressor according to claim 18, further comprising:

a mechanical seal installed between the first cover and the hermetic container that rotatably supports the first cover.

* * * * *